US006320360B1

(12) United States Patent
Zannini

(10) Patent No.: US 6,320,360 B1
(45) Date of Patent: Nov. 20, 2001

(54) ENERGY DIMMER DRIVE AND ENERGY PILOT

(76) Inventor: Lorenzo Zannini, Via Croce No. 58, 42035 Castelnova ne Monti (IT)

( * ) Notice: Subject to any disclaimer, the term of this patent is extended or adjusted under 35 U.S.C. 154(b) by 0 days.

(21) Appl. No.: 09/765,689

(22) Filed: Jan. 19, 2001

(30) Foreign Application Priority Data

May 10, 2000 (IT) ..... RE2000A43

(51) Int. Cl.[7] ..... G05F 1/12
(52) U.S. Cl. ..... 323/249; 323/264
(58) Field of Search ..... 323/249, 250, 323/264, 247

(56) References Cited

U.S. PATENT DOCUMENTS 4,540,931 * 9/1985 Hahn ..... 323/264
4,904,921 * 2/1990 DeVito et al. ..... 323/264
5,327,030 * 7/1994 DeVito et al. ..... 323/264 X

* cited by examiner

*Primary Examiner*—Jessica Han
(74) *Attorney, Agent, or Firm*—Collard & Roe, P.C.

(57) ABSTRACT

The invention includes an energy dimmer drive and energy pilot that controls the amount of current and voltage conveyed from an input to a load, based on values selected by the user. The current and voltage is varied by controlling the spacing between the primary and secondary winding of a variable transformer, as well as the movement of a core in the transformer through a minicomputer, relay cards and/or transistors, sensors and readers. The electric energy power variation is continuous, always rephased according to pre-established values and without microswitches, and is controlled instantaneously.

7 Claims, 1 Drawing Sheet

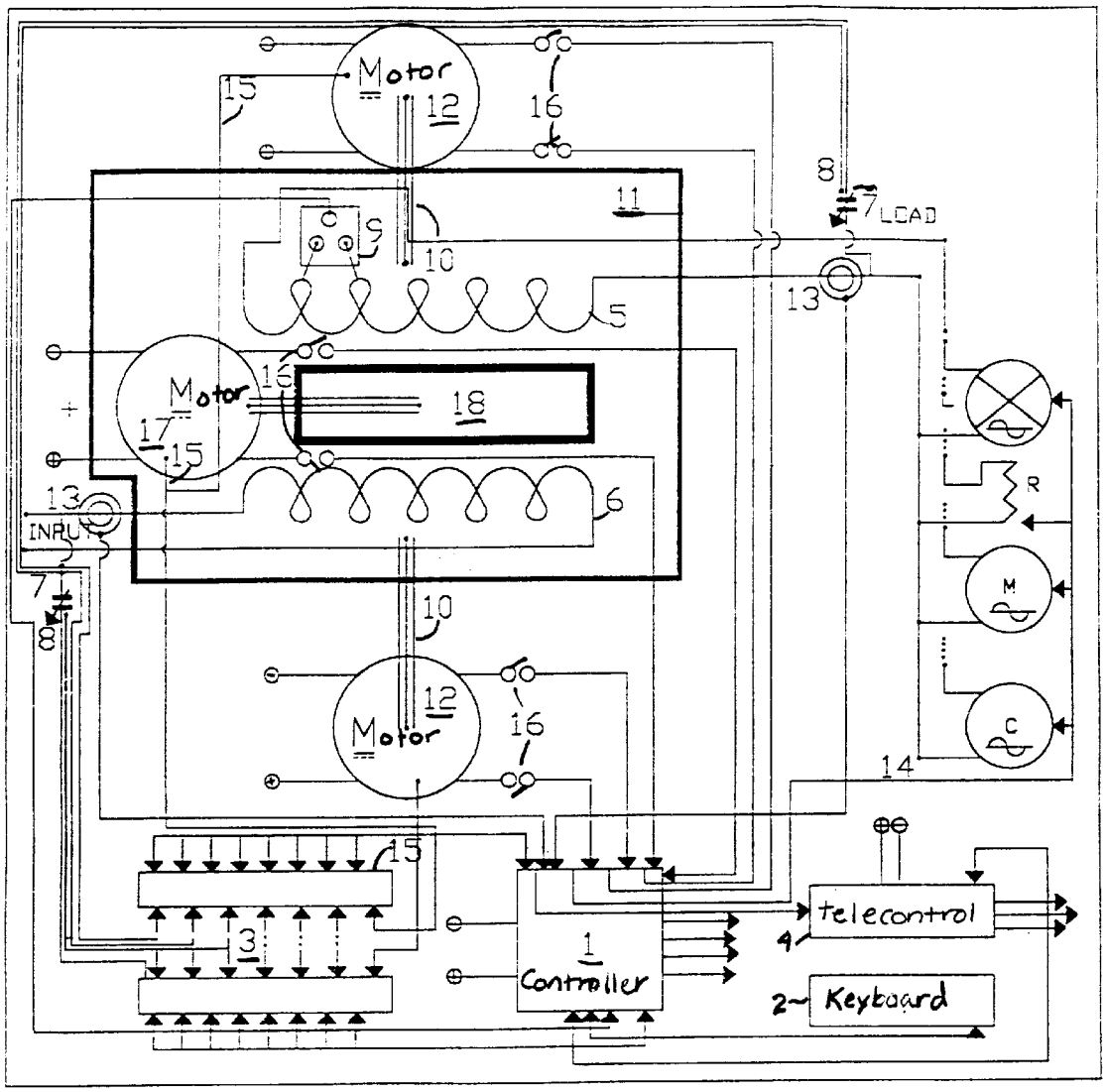
Motor
12
15
16
11
8
7
LOAD
9
10
13
5
Motor
16
18
17
15
+
13
INPUT
6
7
8
10
Motor
12
16
14
L
R
M
C
15
3
1
Controller
telecontrol
4
2
Keyboard

ENERGY DIMMER DRIVE AND ENERGY PILOT

BACKGROUND OF THE INVENTION

FIELD OF THE INVENTION

This invention relates to a voltage control system for dispensing optimal quantities of electrical energy from a central source to individual users.

SUMMARY OF THE INVENTION

It is an object of the invention to use energy produced by any electric generator or by public utilities or private distribution networks and to dispense it in the desired optimal quantity to the ultimate user's plant.

In a first embodiment of the invention, the voltage is controlled by varying the distance between two moving coils of a variable transformer. This is accomplished via an actuating device positioned at the head of the core. In addition, the core is also moved between the coils to vary the amount of the core that is present between the two coils. The variation of reciprocal position between two or more coils can be carried out continuously through pulses generated by a minicomputer with a suitable control card.

In a second embodiment, the primary winding of the transformer is stationary and the secondary winding is moving. The distance between the two coils is varied by linked magnetic flux taking place by separating the second winding from the primary and inserting one or more moving cores between the columns of the transformer, activated by a suitable device.

In a third embodiment, both coils of the transformer are stationary and the variation of linked magnetic flux takes place by inserting one or more moving cores between the columns of the transformer through a suitable mechanical device.

In all three embodiments, providing for different methods of control of movement and positions of the components, a variation of linked magnetic flux of the transformer is obtained and, therefore, control of the electromotive force supplied to the load.

The invention consists of continuously regulating and stabilizing the combined load feed, for control of the power factor on input and output, which favors a reduction of the reactive component of the electric power and reduces the costs of operation of the ultimate users' plants. The voltage reducing equipment can be used for high power values, without using power contacts or other electromechanical systems, which are used in other systems for varying voltage.

This system does not produce interruptions of electric power, since it provides solely for continuous variations of the functional parameters and does not produce micro interruptions of voltage, which in the case of lighting equipment, is often the cause of sudden failures of lamps.

The system controls the variation of self-induced electromotive force in a variable transformer in a system of moving and/or stationary coils inserted in a moving or stationary core having a rectangular cross-section(s) or other variable shape(s), through a microprocessor and appropriate control cards. The system allows for a reduction or increase of electromotive force accompanied by a continuous automatic correction with sensors and/or readers of the quantity of power through discontinuous variation of the absorbed current of capacitors placed in parallel with the load, in single phase or in three phases simultaneously.

There is an automatic correction of movement due to electrodynamic repulsion or attraction exerted by the coils with each other, and stabilization of voltage values on the output to the load through control of the distance between coils.

The section of the moving core and of the air gap can be varied through the mechanical insertion of magnetic lamination columns with their grains or laminations oriented or not, for control of the useful section of the magnetic core, involved in coupling between the coils and the cores themselves.

The insertion of moving cores takes place between the columns of the transformer and between the coils (primary and secondary winding for single phase) in both directions. The voltage can be increased over network values through a different turn ratio between the coils, with automatic control of output voltage, depending on the values programmed. The power can be automatically corrected with values pre-established by the user for a single phase. The system offers different structural configurations of the variable transformer and, therefore, the design choice is a direct consequence of the specific use application.

The design choice makes possible the use of three different systems for energy control:

(a) stationary coils, and a variable section of moving core that is horizontally inserted between the coils with a mechanical actuator;

(b) a stationary primary winding and a movable secondary winding, with a variable section of core that is inserted between the columns with a mechanical actuator; or (c) movable primary and secondary windings with a movable core inserted between the coils.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

The FIGURE shows a schematic view of the system according to the invention.

DETAILED DESCRIPTION OF THE PREFERRED EMBODIMENT

Referring now in detail to the drawing, there is shown a controller 1 in the form of a microprocessor, having eight-output multiple relay cards and/or transistors 3 for control of equipment components, each dedicated to specific use for control and operation of equipment. Controller 1 has an alphanumeric display with keyboard 2 for insertion and control of data and functions by the user. There is a telecontrol station 4 for control room data transmission.

There is a transformer 11 with a magnetic flux divider, operable with cores of different shapes and dimensions. Transformer 11 supplies power, either single phase, two phase or three phase, to a user's load through a control of electromotive force which is continuously variable on the basis of values selected by the user.

Transformer 11 transforms energy from a feeder line with network voltage to an output line with variable current voltage by varying the magnetic flux, which occurs by varying the horizontal distance between centers of moving coils 5, 6. This is accomplished by a combination of the turn ratio between the primary moving coil 6 and secondary moving coil 5, and by the regulation of magnetic flux. The magnetic flux is also regulated by controlling the section and position of a core 18 inserted in air gaps between the coils 5, 6 of the transformer.

There are mechanical/electrical actuators in the form of motors 12 with endless screw(s) 10 placed on the axis of variable core 18, for displacement of the moving coils along the axis on the longitudinal plane of the core. There are a series of relays and/or transistors 15 for on/off control of timed motor operation. There is a control switch 9 for automatically boosting the voltage.

The coils can be driven on two different mechanical actuators or motors 12, the first placed at the head of the primary winding 5 and the second placed at the head of the secondary winding 6. Moving core 18 can be moved with a mechanical or electrical actuator system in the form of a motor 17 placed perpendicular to core 18, which is driven horizontally inside the columns of transformer 11. Switches 16 allow for manual and automatic drive and control of the motors 12 and 17.

There are capacitors 7, 8, which are single-phase or three-phase, that are automatically inserted parallel to the load and are capable of compensating for or optimizing the power in a single phase or three phases. The invention provides a device for measuring and signaling the principal electric quantities and possible operating anomalies. Ammeter 13 allows for automatic on/off insertion of capacitors 7, 8 and for controlling of instantaneous currents by the operation of endless screw 10.

The loads that are connected to receive the power can be an internal and external illumination load L, an electric heating and/or ventilation load R, a load of motors with speed control M, or a load of air conditioning compressors C.

The energy dimmer drive system according to the invention makes it possible to use electrical devices while conserving absorbed power at the ultimate user's plant in the following individual or simultaneous applications: industrial plant motors in general, air conditioning compressors; outdoor, indoor and street lighting; industrial refrigeration compressors and motors; asynchronous motor starting; or pumping systems with electric motors. The shape and design of the system allows for a wide range of power, in single-phase and two-phase as well as three-phase systems, with the presence of balanced and unbalanced loads without presenting any type of operating problem.

Accordingly, while only a few embodiments of the present invention have been shown and described, it is obvious that many changes and modifications may be made thereunto without departing from the spirit and scope of the invention.

What is claimed is:

1. A system for controlling the amount of voltage transferred from an input to a load, comprising:

a transformer having a primary winding and a secondary winding, separated from each other by a space;

a movable core disposed in the space between the primary and secondary windings;

a device connected to the core for moving the core longitudinally within the space;

at least one actuator connected to at least one of the primary and secondary windings for varying the space between the primary and secondary windings; and a controller for automatically signaling at least one of said device and said actuator to move the core or to vary the space between the windings, to vary the voltage transferred to the load according to preprogrammed parameters.

2. The system according to claim 1, wherein the primary and secondary windings are each connected to a separate actuator that moves both windings to vary the space between the windings.

3. The system according to claim 1, wherein the actuator comprises a motor with an endless screw connected to one of said windings.

4. The system according to claim 1, further comprising at least one capacitor connected to said system for optimizing the power transferred to the load.

5. A system for controlling the amount of voltage transferred from an input to a load, comprising:

a transformer having a primary winding and a secondary winding, separated from each other by a space;

a movable core disposed in the space between the primary and secondary windings;

a device connected to the core for moving the core longitudinally within the space, wherein the device comprises a motor with an endless screw connected to said core; and a controller for automatically signaling said device to move the core, to vary the voltage transferred to the load according to preprogrammed parameters wherein the device comprises a motor with an endless screw connected to said core.

6. A system for controlling the amount of voltage transferred from an input to a load, comprising:

a transformer having a primary winding and a secondary winding, separated from each other by a space;

a movable core disposed in the space between the primary and secondary windings;

a device connected to the core for moving the core longitudinally within the space; and a controller for automatically signaling said device to move the core, to vary the voltage transferred to the load according to preprogrammed parameters, wherein the controller comprises a microprocessor attached to an alphanumeric display and keyboard for inputting selected parameters to control the movement of the windings and the core.

7. The system according to claim 6, wherein the controller further comprises eight-output multiple control and power cards.

* * * * *